US011286611B2

(12) United States Patent
Lao et al.

(10) Patent No.: US 11,286,611 B2
(45) Date of Patent: Mar. 29, 2022

(54) WASHING MACHINE

(71) Applicants: QINGDAO HAIER WASHING MACHINE CO., LTD., Shandong (CN); QINGDAO HAIER SMART TECHNOLOGY R&D CO., LTD., Shandong (CN)

(72) Inventors: Chunfeng Lao, Shandong (CN); Sheng Xu, Shandong (CN); Yanfen Lv, Shandong (CN); Xinghui Hao, Shandong (CN); Yimin Li, Shandong (CN); Di Wu, Shandong (CN)

(73) Assignees: QINGDAO HAIER WASHING MACHINE CO., LTD., Shandong (CN); QINGDAO HAIER SMART TECHNOLOGY R&D CO., LTD., Shandong (CN)

( * ) Notice: Subject to any disclaimer, the term of this patent is extended or adjusted under 35 U.S.C. 154(b) by 171 days.

(21) Appl. No.: 16/493,960

(22) PCT Filed: Mar. 16, 2018

(86) PCT No.: PCT/CN2018/079216
§ 371 (c)(1),
(2) Date: May 11, 2020

(87) PCT Pub. No.: WO2018/166511
PCT Pub. Date: Sep. 20, 2018

(65) Prior Publication Data

US 2020/0299891 A1 Sep. 24, 2020

(30) Foreign Application Priority Data

Mar. 16, 2017 (CN) ..... 201710156749.9

(51) Int. Cl.
*D06F 39/08* (2006.01)
*D06F 23/04* (2006.01)
(Continued)

(52) U.S. Cl.
CPC ..... *D06F 39/083* (2013.01); *D06F 23/04* (2013.01); *D06F 37/12* (2013.01); *D06F 37/206* (2013.01);
(Continued)

(58) Field of Classification Search
CPC ..... D06F 39/10; D06F 39/08; D06F 39/081; D06F 39/083; D06F 23/04; D06F 37/12; D06F 37/206; D06F 37/24; D06F 37/30
See application file for complete search history.

(56) References Cited

U.S. PATENT DOCUMENTS 2,554,229 A * 5/1951 Woodson ..... D06F 13/02 68/23.5
5,152,159 A * 10/1992 Kabeya ..... D06F 39/083 68/12.02
(Continued)

FOREIGN PATENT DOCUMENTS

CN 2397150 Y 9/2000
CN 1389616 A 1/2003
(Continued)

OTHER PUBLICATIONS

International Search Report (PCT/ISA/210), with translation, and Written Opinion (PCT/ISA/237) dated Jun. 21, 2019, by the Chinese Patent Office as the International Searching Authority for International Application No. PCT/CN2018/079216.

*Primary Examiner* — Joseph L. Perrin
(74) *Attorney, Agent, or Firm* — Buchanan Ingersoll & Rooney PC

(57) ABSTRACT

A washing machine comprises a cabinet, a washing drum rotatably arranged in the cabinet, wherein the washing drum
(Continued)

is a water holding drum to accommodate washing water, a water drainage channel which discharges water from top to bottom is arranged at an inner side of a peripheral wall of the washing drum, an upper end of the water drainage channel communicates with the inside of a washing drum, and a lower end communicates with the outside of the washing drum. The water drainage channel comprises a water channel casing and at least part of a washing drum wall, and one side, facing the washing drum wall, of the water channel casing is provided with a cut-through groove, the water channel casing is fastened on the washing drum wall, and forms a water flow channel together with the washing drum wall.

18 Claims, 4 Drawing Sheets

(51) Int. Cl.

| | |
|---|---|
| ***D06F 37/24*** | (2006.01) |
| ***D06F 37/12*** | (2006.01) |
| ***D06F 37/20*** | (2006.01) |
| *D06F 37/30* | (2020.01) |
| *D06F 39/10* | (2006.01) |

(52) U.S. Cl.
CPC ..... *D06F 39/08* (2013.01); *D06F 37/24* (2013.01); *D06F 37/30* (2013.01); *D06F 39/081* (2013.01); *D06F 39/10* (2013.01)

(56) References Cited

U.S. PATENT DOCUMENTS

| | | | | |
|---|---|---|---|---|
| 2007/0283728 | A1* | 12/2007 | Wong | D06F 39/007 68/5 R |
| 2011/0154676 | A1* | 6/2011 | Castiglione | D06F 58/206 34/86 |
| 2013/0031938 | A1* | 2/2013 | Cho | D06F 13/02 68/133 |
| 2013/0036776 | A1* | 2/2013 | Seo | D06F 37/12 68/18 F |
| 2014/0026624 | A1* | 1/2014 | Oh | D06F 13/00 68/18 F |
| 2015/0052954 | A1* | 2/2015 | Erickson | D06F 17/06 68/17 R |
| 2016/0305057 | A1* | 10/2016 | Coxon | F16C 11/068 |
| 2017/0030002 | A1* | 2/2017 | Alexander | D06F 23/04 |
| 2019/0093277 | A1* | 3/2019 | Kim | D06F 39/083 |

FOREIGN PATENT DOCUMENTS

| | | | |
|---|---|---|---|
| CN | 2658193 | Y | 11/2004 |
| CN | 101560721 | A | 10/2009 |
| CN | 105568616 | A | 5/2016 |
| CN | 105714514 | A | 6/2016 |
| CN | 106868774 | A | 6/2017 |
| CN | 106906610 | A | 6/2017 |
| JP | 2004321683 | A | 11/2004 |
| JP | 2013141508 | A | 7/2013 |

* cited by examiner

WASHING MACHINE

TECHNICAL FIELD

The present disclosure relates to a clothes washing device, in particular to a washing machine.

BACKGROUND ART

An existing impeller-type washing machine generally includes a washing drum, an outer drum, a damping piece and a power system. During clothes washing and dehydration, a washing drum rotates relative to an outer drum, such that clothes and washing water produce an effect to achieve an object of washing clothes or dehydrating. Wherein an outer drum is taken as a water holding drum, in a process of washing clothes, the outer drum is not in contact with clothes, the outer drum is installed outside a washing drum, so as to provide support for the washing drum.

Along with constant development of techniques of a washing machine, the capacity of a washing machine gradually tends to become bigger and bigger. While the gradually increased large capacity of a washing machine inevitably leads to an increase in an overall size of a washing machine, therefore, it is of great necessity to provide a washing machine with a small size and a large capacity. Meanwhile, for the existing washing machine, during clothes washing, water is distributed in a rotating drum and a water holding drum, that is, water is also distributed between the water holding drum and the rotating drum, therefore, water consumption is large, and water resources are wasted; for the existing washing machine, dirt easily remains between the water holding drum and a rotating drum, thereby breeding bacteria, moreover, since water is distributed between a water holding drum and a rotating drum, the consumption of detergent is also large, thereby leading to a waste of detergent resources and being not beneficial for saving cost.

A Chinese disclosure patent with an application number of CN99230455.5 discloses a single-drum water-saving washing machine, wherein a water collecting device is arranged at a drum opening of a washing drum, the water collecting opening of a water collecting device is enclosed at a drum opening along the washing drum, a water collecting chamber arranged at a drum opening of a water collecting device is connected with multiple water drainage pipes, and the water drainage pipes are arranged symmetrically from top to bottom along an outer wall of a washing drum. During drying, the water collecting device collects centrifugal water flow caused by high-speed rotation and leads downwards and discharges the water flow. In the patent, although an outer drum is omitted, however, the water collecting opening and the water drainage pipe are both arranged outside a drum, during dehydration of a washing machine, an inner wall of a cabinet is easily collided, thereby leading to abrasion of the water collecting opening and the water drainage pipe and leading to water leakage, and shortening service life of a washing machine.

In view of this, the present disclosure is hereby proposed.

SUMMARY

An object of the present disclosure is to overcome shortcomings of the prior art, and provide a washing machine which can enlarge volume of a washing drum, improve water-saving effect and dehydration efficiency, and has long service life.

In order to realize the present object, the present disclosure adopts the following technical solution:

A washing machine includes:

a cabinet;

a washing drum, which is rotatably arranged in the cabinet and taken as a water holding drum to accommodate washing water, wherein a lower part of the washing drum is provided with a water drainage outlet;

a water drainage channel, which is arranged at an inner side of a peripheral wall of a washing drum and discharges water from top to bottom, wherein an upper end is communicated with the inside of a washing drum, and a lower end is communicated with a water drainage outlet of a washing drum, such that washing water, which rises under an effect of an eccentric force, in a washing drum is guided from top to bottom to a water drainage outlet via the water drainage channel and is discharged.

Further, an upper end of the water drainage channel is provided with a water inlet, the water drainage outlet is arranged at a lower part of a peripheral wall of a washing drum or at a bottom of a washing drum, and the water drainage channel defines a water drainage cavity which is communicated with the water inlet and the water drainage outlet.

Further, the water drainage cavity is separately defined by a hollow structure inside the water drainage channel or is defined jointly through an inner peripheral wall surface of a washing drum covered by the water drainage channel.

Further, the water drainage channel includes a water channel casing and at least part of a washing drum wall, a side, facing a washing drum wall, of the water channel casing is provided with a cut-through groove, the water channel casing is fastened on the washing drum wall, and forms a water flow channel together with the washing drum wall.

Further, the water channel casing is detachably installed on the washing drum;

preferably, a clamping hook is arranged at a bottom part of the water channel casing, a drum wall of the washing drum is provided with a bayonet which is in match with the clamping hook, an upper part of the water channel casing is provided with a screw hole, and the water channel casing is fixedly connected with a washing drum via a screw.

Further, projections or veins which are used for being in contact friction with clothes are arranged on a side, facing an axis of a washing drum, of the water channel casing.

Further, a lower end of the water drainage channel is connected with a water drainage outlet at the bottom of a washing drum, the water drainage outlet is arranged below an impeller of a washing machine, and the water drainage channel extends to the water drainage outlet.

Further, at least one water drainage channel is available, preferably, at least two water drainage channels are available, and are arranged at intervals along a circumferential direction of the washing drum.

Further, the water drainage outlet is arranged at a lower part of a peripheral wall of a washing drum, at least one water drainage outlet is available, at least one water drainage channel is available, and each water drainage channel covers at least one corresponding water drainage outlet.

Further, at least two water drainage outlets are available and are arranged at intervals along a circumferential direction of a washing drum, and at least two water drainage channels are available and are arranged at intervals along a circumferential direction of a washing drum.

Further, an upper end of the washing drum is provided with a water collecting ring, a dehydration outlet which is communicated with the inside of a washing drum is arranged at a side, facing a washing drum, of the water collecting ring, and an upper end of the water drainage channel is communicated with the water collecting ring, to guide and discharge water in the water collecting ring.

Further, a top end of the washing drum is provided with a balancing ring, and the water collecting ring is arranged inside the washing drum and at a lower side of the balancing ring.

Further, the water collecting ring is internally provided with a water retaining plate which guides washing water to enter into a water drainage channel after changing direction, and the water retaining plate is arranged above a water inlet of the water drainage channel, and is set to be inclined with a horizontal surface at which the water collecting ring is located at a certain angle.

Further, a side, facing an axis of a washing drum, of the water collecting ring is a cambered surface, and the cambered surface is gradually bent from bottom to top towards a center of a washing drum along an axial direction of a washing drum;

preferably, the water drainage port of the water collecting ring is arranged at an initial end of a bottom part of the cambered surface.

Further, the washing machine includes a mounting plate which is installed on a lower part of the washing drum and configured to support a washing drum, wherein the mounting plate is connected with a cabinet via a damping piece.

Further, the mounting plate is provided with a water retaining ring, the water retaining ring extends towards a direction of a washing drum, to form a concave cavity structure which accommodates washing water, a lower end of the water drainage channel discharges water to the concave cavity structure, and a bottom part of the concave cavity structure is connected with a water drainage pipe which discharges water out of a washing machine;

preferably, the height of the water retaining ring is slightly higher than a bottom surface of a washing drum, and a certain gap is reserved between the water retaining ring and an outer peripheral wall of the washing drum.

Further, a valve plug configured to open and close a water drainage outlet is installed, corresponding to a water drainage outlet at the bottom part of a washing drum, on the mounting plate, and the valve plug is arranged at an inner side of the water retaining ring.

Further, the mounting plate is further provided with a locking structure, the locking mechanism is arranged at a bottom part of the washing drum, and is in match with the washing drum, to limit rotation of the washing drum when a water drainage outlet is closed by a valve plug.

Further, the washing machine includes a power device which drives a washing drum to rotate, wherein the power device is installed at a bottom part of the mounting plate, and includes a motor and a decelerating clutch, and a rotating shaft of the motor is directly or indirectly connected with a bottom of the washing drum, to drive rotation of a washing drum.

Further, the damping piece includes a boom and a boom socket, an edge of the mounting plate is provided with a bayonet which is in match with the boom socket, and the boom socket is clamped in the bayonet, and is arranged at a lower side of the mounting plate.

After the technical solution of the present disclosure is adopted, the following beneficial effects are brought:

In a washing machine of the present disclosure, an outer drum structure is omitted, and a washing drum of a washing machine is directly taken as a water holding drum, thereby being capable of improving use ratio of washing water, and reducing use amount of washing water. Meanwhile, after an outer drum is omitted, the size of a washing drum can be set to be bigger, the number of clothes to be washed is accordingly increased, thereby achieving an object of expanding capacity of a washing machine. On the other hand, a water drainage channel in the present disclosure is arranged on an inner side of a washing drum, during dehydration of a washing machine, the water drainage channel will not directly collide with a cabinet, therefore, during dehydration of a washing machine, the noise is lower and the service life is longer.

A further detailed description will be given below on specific embodiments of the present disclosure in combination with accompanying drawings.

BRIEF DESCRIPTION OF THE DRAWINGS

As a part of the present disclosure, accompanying drawings are used for providing a further understanding of the present disclosure, schematic embodiments and descriptions thereof of the present disclosure are used for explaining the present disclosure, rather than constituting an improper limit to the present disclosure. Obviously, accompanying drawings described below are merely some embodiments, for those skilled in the art, other drawings can be obtained based on these drawings without any creative effort. In the drawings.

Figure 1:
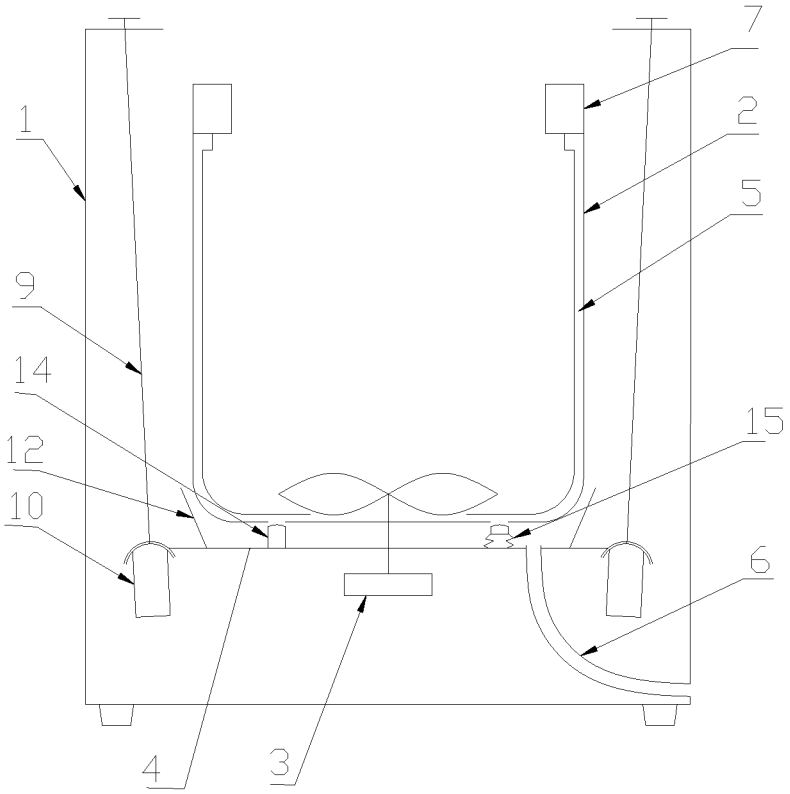
FIG. 1 is a schematic diagram of principles of the present disclosure.

Reference numerals in the figures: 1, cabinet 2, washing drum 21, water drainage outlet 3, power device 4, mounting plate 5, water drainage pipeline 51, water inlet 52, water drainage cavity 6, water drainage pipe 7, balancing ring 8, water collecting ring 9, boom 10, boom socket 11, water channel casing 12, water retaining ring 13, water retaining plate 14, locking mechanism 15, valve plug 16, concave cavity structure 17, impeller.

It should be noted that, these drawings and text descriptions are not aiming at limiting a conception range of the present disclosure in any form, but to describe concepts of the present disclosure for those skilled in the art with a reference to specific embodiments.

DESCRIPTION OF THE EMBODIMENTS

In order to make the object, technical solutions and advantages of embodiments of the present disclosure clearer, a clear and complete description will be given below on technical solutions in the embodiments in combination with accompanying drawings in embodiments of the present disclosure. The following embodiments are used for describing the present disclosure, rather than for limiting the scope of the present disclosure.

In the description of the present disclosure, it should be noted that, the directional or positional relationship indicated by such terms as “upper”, “lower”, “front”, “rear”, “left”, “right”, “vertical”, “inner” and “outer” is the directional or positional relationship shown based on the drawings, which is merely for convenient and simplified description of the present disclosure, rather than indicating or implying that the referred device or element must have the specific direction or must be constructed and operated in the specific direction, therefore, it cannot be understood as a limitation to the present disclosure.

In the description of the present disclosure, it should be noted that, unless otherwise definitely prescribed and defined, the terms "installation", "connected" and "connection" should be understood in its broad sense. For example, the "connection" may be a fixed connection, may also be a detachable connection or an integrated connection; and the "connected" may be directly connected and can also be indirectly connected through an intermediate medium. The specific meaning of the above-mentioned terms in the present disclosure may be understood by those of ordinary skill in the art in light of specific circumstances.

A washing machine according to an embodiment of the present disclosure will be described below with reference to accompanying drawings.

Figure 2:
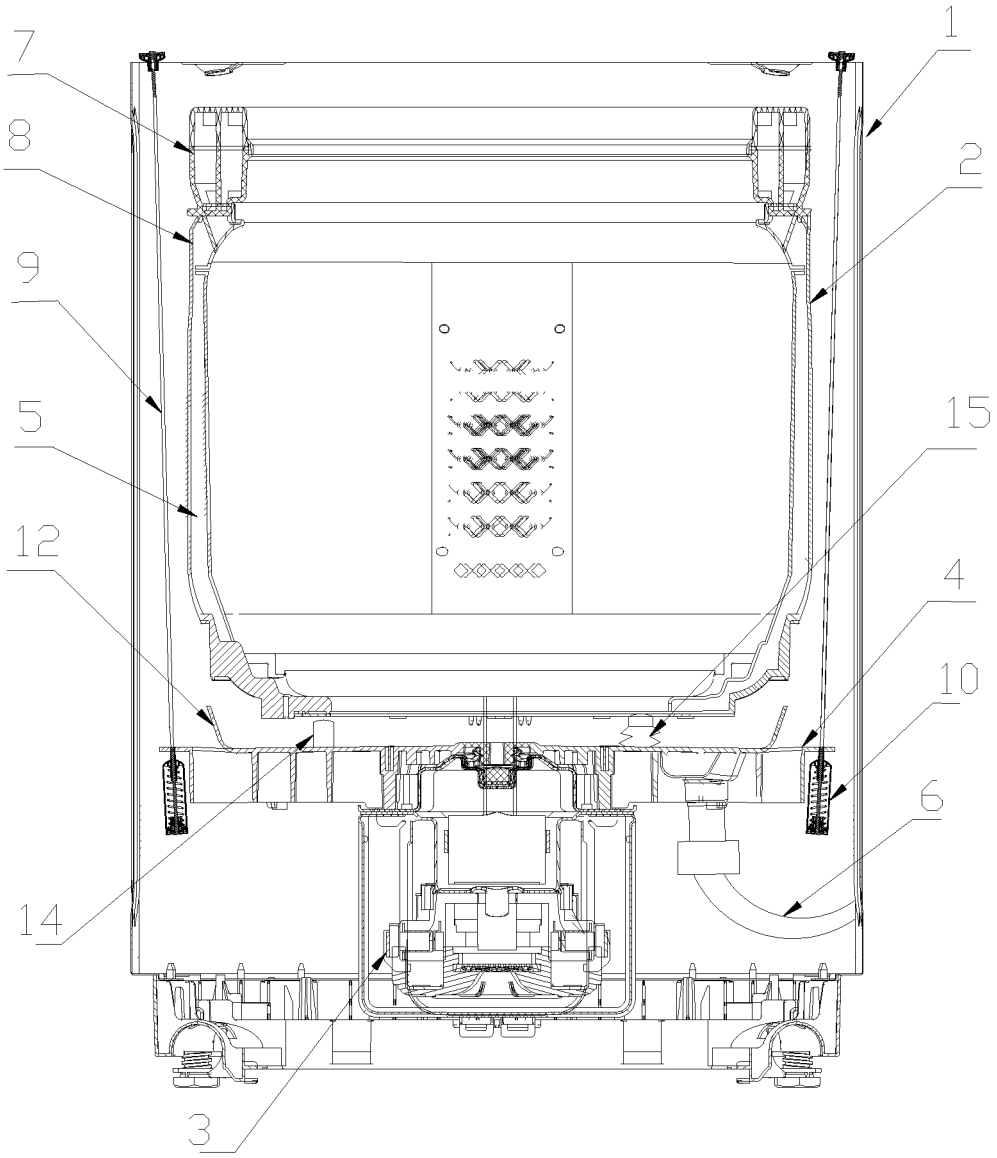
FIG. 2 is a section view of structures of the present disclosure.
Figure 3:
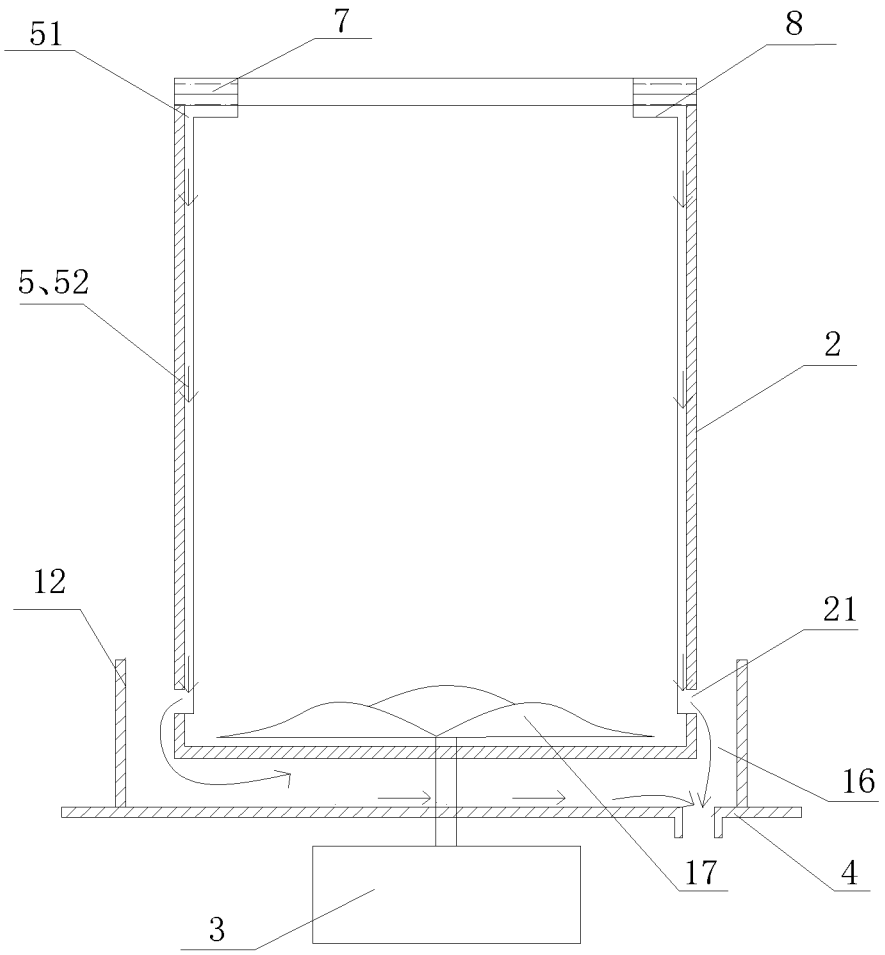
FIG. 3 is a schematic diagram of water drainage of the present disclosure.

As shown in FIG. 1 to FIG. 3, a washing machine according to an embodiment of the present disclosure includes a cabinet 1, a washing drum 2 and a water drainage channel 5.

A washing drum 2 is rotatably arranged in the cabinet 1, a water drainage outlet 21 is arranged on a periphery wall and/or a bottom wall of the washing drum 2, a water drainage channel 5 is arranged on an inner peripheral wall surface of a washing drum 2, and a lower end of the water drainage channel 5 is communicated with a water drainage outlet 21, and an upper end of the water drainage channel 5 is provided with a water inlet 51, and the water drainage channel 5 defines a water drainage cavity 52 which is communicated with a water inlet 51 and a water drainage outlet 21. Liquid, which rises under an effect of an eccentric force, in the washing drum 2 enters into a water drainage cavity 52 via the water inlet 51 and is discharged via a water drainage outlet 21.

Specifically speaking, during dehydration of a washing machine, a rotating drum 2 rotates, that is, a water drainage channel 5 rotates along with a washing drum 2, liquid in the washing drum 2 moves upwards under the effect of an eccentric force, and enters into a water drainage cavity 52 via a water inlet 51, and liquid entering into the water drainage cavity 52 is guided to a water drainage outlet 21 via a water drainage channel 5, and is discharged via the water drainage outlet 21.

A washing machine according to an embodiment of the present disclosure adopts a single-drum structure, that is, only a washing drum 2 is arranged and no water holding drum is arranged, in this way, during clothes washing, water is in the washing drum 2, thereby being more water-saving, moreover, through further arranging a water drainage channel 5 on an inner peripheral wall surface of a washing drum 2, and through arranging a water inlet 51 on a water drainage channel 5 and arranging a water drainage outlet 21 on a peripheral wall and/or bottom wall of a washing drum 2, during dehydration, water in the washing drum 2 rises under an effect of an eccentric force, enters into a water drainage channel 5 via a water inlet 51, flows into a water drainage outlet 21 under the guide of a water drainage channel 5, and is discharged via a water drainage outlet 21. Therefore, a dehydration effect can be improved while a water holding drum is omitted to simplify structure, enlarge capacity, reduce breeding of dirt and bacteria and save water.

Moreover, a water drainage channel 5 is arranged inside a washing drum 2, with no need of considering a collision spacing which needs to be enlarged due to other structures arranged between a cabinet 1 and a washing drum, therefore, under a premise of a constant volume of a cabinet, the volume of a washing drum is relatively improved, and the effect of volume expansion is improved.

A water drainage outlet 21 can be arranged on a peripheral wall of a washing drum 2, and can also be arranged on a bottom wall of a washing drum 2, or the water drainage outlet 21 is arranged on a peripheral wall and a bottom wall. Specifically, the water drainage outlet 21 is arranged on a peripheral wall of a washing drum 2, in this way, the water drainage channel 5 covers the water drainage outlet 21, and a lower end of the water drainage pipe 5 is only connected with a peripheral wall of a washing drum 2, thereby being beneficial for sealing between a water drainage channel 5 and a washing drum 2. Of course, the water drainage outlet 21 of the present disclosure can also be arranged on a bottom wall of a washing drum 2, the water drainage channel 5 extends downwards to communicate with the water drainage outlet 21, thereby being beneficial for improving dehydration efficiency during dehydration, having a favorable dehydration effect, and effectively reducing splashing of water from a water drainage outlet 21. A water drainage outlet 21 is arranged on a peripheral wall and a bottom wall, thereby not only being beneficial for sealing between a water drainage channel 5 and a peripheral wall of a washing drum 2, but also being beneficial for improving dehydration efficiency during dehydration, and effectively preventing water from splashing from a water drainage outlet 21.

In order to improve water drainage effect of a washing machine, multiple water drainage outlets 21 are available, multiple water drainage outlets 21 are arranged at equal intervals along a circumferential direction of a washing drum 2, multiple water drainage channels 5 are available, multiple water drainage pipelines 5 are arranged at intervals along a circumferential direction of a washing drum 2, and each water drainage pipeline 5 covers at least one corresponding water drainage outlet 21. For example, two water drainage outlets 21 are available and are arranged oppositely along a radial direction of a washing drum 2, two water drainage channels 5 are available and are arranged oppositely along a radial direction of the washing drum 2, and two water drainage channels 5 respectively cover two water drainage outlets 21 in a one-to-one corresponding manner (please refer to FIG. 3).

Therefore, a washing machine of the present disclosure has the advantages of large capacity, saving water, avoiding dirt, low cost, favorable water drainage effect, elegant appearance, and being beneficial for sealing.

Embodiment 1

As shown in FIG. 1 and FIG. 2, the washing machine of the present embodiment includes a cabinet 1, a washing drum 2 configured to accommodate to-be-washed clothes, a power device 3 driving rotation of a washing drum 2 and a mounting plate 4 installed at a lower part of a washing drum 2, and a damping piece connecting a mounting plate 4 and a cabinet 1. The washing drum 2 can be rotatably arranged in the cabinet 1, the washing drum 2 is located on a mounting plate 4, and can rotate relative to the mounting plate 4, the washing drum 2 is taken as a water holding drum to accommodate washing water, the mounting plate 4 is configured to support a washing drum 2, and the mounting plate 4 is movably connected with a cabinet 1 through a damping piece, during washing or dehydration, the washing drum 2 and the mounting plate 4 will vibrate, and the vibration is transmitted to a damping piece and is absorbed.

A balancing ring 7 is arranged on a top end of the washing drum 2, a lower side of a balancing ring 7 is provided with a water collecting ring 8, a water drainage channel 5 is arranged at an inner side of a peripheral wall of a washing drum 2, the water collecting ring 8 is communicated with the water drainage channel 5, a dehydration outlet is arranged at a side, facing a washing drum 2, of the water collecting ring 8, the water drainage channel 5 is vertically arranged, an upper end is communicated with the water collecting ring 8, and a lower end is communicated with a water drainage outlet arranged at a bottom part of the washing drum. The washing drum 2 has a certain conicity, when the washing drum 2 rotates at a high speed, washing water in the washing drum 2 will climb up along a wall of a washing drum under the effect of an eccentric force, and enters into a water collecting ring 8 from a dehydration outlet of a water collecting ring 8 after rising to a certain height, the washing water flows in the water collecting ring 8 in an annular manner, when the rotating speed of a washing drum 2 decreases, washing water will flow downwards along a water drainage channel 5, and is discharged finally from a water drainage outlet of a washing machine.

Embodiment 2

Figure 4:
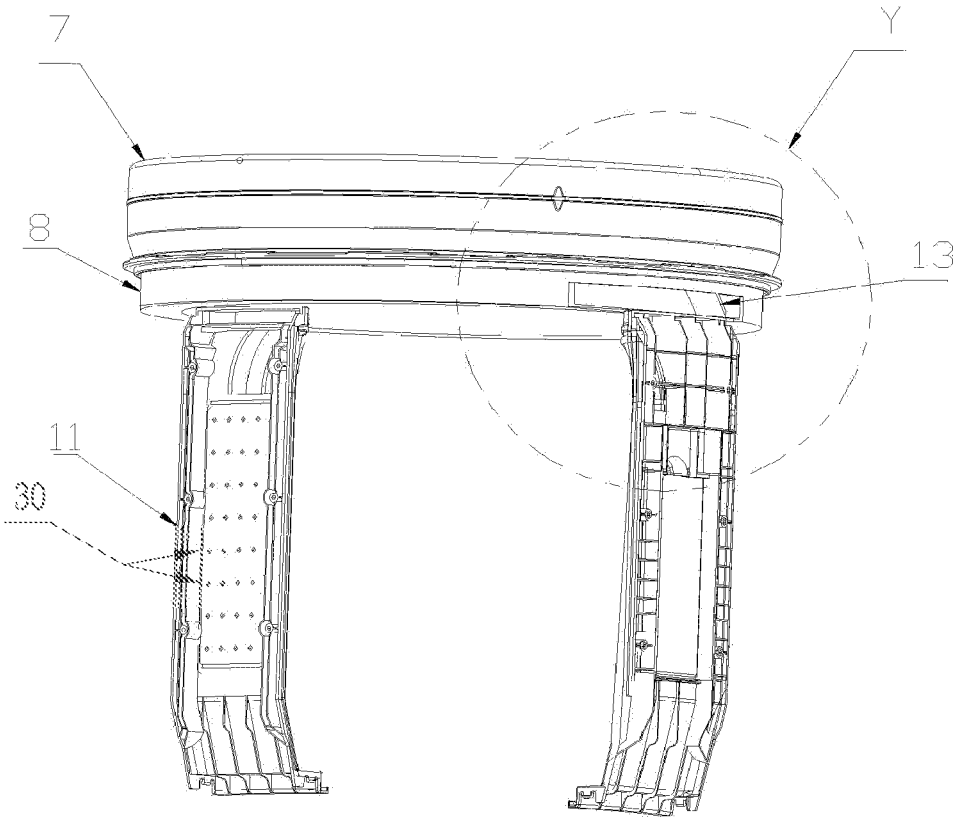
FIG. 4 is a structural diagram of part of a water drainage channel of the present disclosure.
Figure 5:
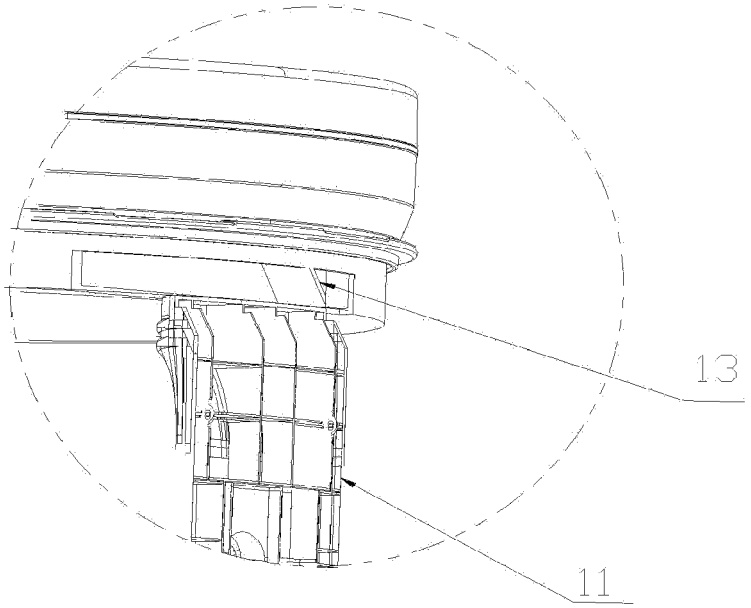
FIG. 5 is a partially enlarged view of Y of FIG. 4.

A lower end of the water drainage channel 5 of the present embodiment is connected with a water drainage outlet at a bottom part of a washing drum 2 (not shown in the figures), the water drainage outlet is arranged below an impeller of a washing machine, the water drainage channel 5 extends to the water drainage outlet, as shown in FIG. 4 and FIG. 5, the water drainage channel 5 includes a water channel casing 11 and part of a washing drum wall, a side, facing a washing drum wall, of the water channel casing 11 is provided with a cut-through groove, the water channel casing 11 is fastened on the washing drum wall, and forms a water flow channel together with the washing drum wall. The water channel casing 11 is similar to a water channel structure in an inner drum of the existing washing machine, the difference is that an upper end of the water channel casing 11 extends until the water channel casing 11 is connected with a water collecting ring 8, and no water outlet is arranged on a side, facing an axis of the washing drum 2, of the water channel casing 11.

The water channel casing 11 can be provided with multiple parallel grooves, to form multiple water flow channels.

Preferably, the water channel casing 11 can be detachably installed on a washing drum 2, a bottom part of the water channel casing 11 is provided with a clamping hook, a drum wall of the washing drum 2 is provided with a bayonet which is in match with the clamping hook, an upper part of the water channel casing 11 is provided with a screw hole, and is fixedly connected with a washing drum 2 via a screw. When the water channel casing 11 is installed, the clamping hook is firstly clamped on a bayonet, to locate and support the water channel casing 11, and then the water channel casing 11 is fixed on a washing drum 2 through a screw.

Preferably, projections or veins 30 which are used for being in contact friction with clothes are arranged on a side, facing an axis of a washing drum, of the water channel casing 11. In a clothes washing process, the water channel casing 11 faces the surface of a washing drum axis, thereby playing a role of being in friction with clothes.

Embodiment 3

As shown in FIG. 3, a water retaining ring 12 is arranged on the mounting plate 4 in the present embodiment, the water retaining ring 12 protrudes towards a direction of a washing drum 2 from an upper surface of the mounting plate 4, and extends for a certain height, to form a concave cavity structure 16 which accommodates washing water, a bottom part of the concave cavity structure 16 is provided with an opening and is connected with a water drainage pipe 6, the water drainage pipe 6 is communicated with a water drainage outlet of a washing machine, preferably, the height of the water retaining ring 12 is slightly higher than a bottom surface of a washing drum 2, and a bigger gap is reserved between the water retaining ring 12 and an outer peripheral wall of the washing drum 2, to avoid collisions when a washing drum 2 rotates.

As shown in FIG. 1 and FIG. 2, a valve plug 15 is installed on a water drainage outlet at a bottom part of the washing drum 2, the valve plug 15 is arranged at an inner side of a water retaining ring 12. In a clothes washing stage, the valve plug 15 is in a closed state, in a dehydration stage, the valve plug 15 is in an open state, after the valve plug 15 is opened, washing water in the washing drum 2 flows into a concave cavity structure 16, and is discharged out of a washing machine via a water drainage pipe 6.

A locking structure 14 is further arranged on an upper surface of the mounting plate 4, the locking mechanism 14 is arranged at a bottom part of the washing drum 2, and is in match with the washing drum 2, to limit rotation of the washing drum 2. The locking mechanism 14 can lock a washing drum 2, to prevent rotation of a washing drum 2. In a clothes washing stage, a locking mechanism 14 locks a washing drum 2, such that the washing drum 2 cannot rotate, and in a dehydration stage, the locking mechanism 14 is unlocked, such that the washing drum 2 can rotate.

Embodiment 4

As shown in FIG. 4 and FIG. 5, in combination with the above embodiments, the water collecting ring 8 of the present embodiment is provided with a water retaining plate 13 which guides washing water into a water drainage channel 5, and the water retaining plate 13 is arranged above a water inlet of a water drainage channel 5, and is set to be inclined with a horizontal surface at a certain angle. When washing water flows in the water collecting ring 8 in an annular manner, washing water will collide onto the water retaining plate 13, and a side, just opposite to a direction of a water flow, of the water retaining plate 13, is set to be inclined downwards, such that water flow changes its flow direction after colliding onto the water retaining plate 13, and water flow flows downwards along a drum wall from flowing along a circumferential direction of a drum, and enters into a water drainage pipe 5. Since a water retaining plate 13 changes a flow direction of a water flow inside the water retaining ring 8, therefore, during high-speed dehydration, water in the water collecting ring 8 can flow into a water drainage channel 5, thereby avoiding excessive water in the water collecting ring 8.

A dehydration process of a washing machine in the present disclosure is as shown in FIG. 3. Firstly, before dehydration, water in a washing drum 2 is discharged via a water drainage outlet at a bottom part of a washing drum 2, and then a motor drives a washing drum 2 to rotate at a high speed, residue water in the washing drum 2 climbs up along a washing drum wall under an effect of an eccentric force, and enters into a water collecting ring 8. In the water collecting ring 8, water flow changes its flow direction under the effect of a water retaining plate 13, flows downwards into a water drainage channel 5, flows out of a washing drum 2 along a water drainage pipe 5, falls within a concave cavity structure 16 formed by a water retaining ring 12, and is finally discharged out of a washing machine via a water drainage pipe 6 (please refer to FIG. 1).

Embodiment 5

In order to prevent washing water from overflowing from a washing drum 2 during dehydration, as shown in FIG. 1, a side, facing an axis of the washing drum, of the water collecting ring 8 is a cambered surface, and the cambered surface is gradually bent from bottom to top towards a center of a washing drum 2 along an axial direction of a washing drum, such that an opening at an upper end of the washing drum 2 gradually decreases, a dehydration outlet of the water collecting ring 8 is arranged at an initial end of a bottom part of the cambered surface, when washing water climbs up along a drum wall, a cambered surface of the water collecting ring 8 plays a role of blocking water flow from climbing up continuously, and gathering water flow into a dehydration outlet of the water collecting ring 8.

Embodiment 6

As shown in FIG. 3, the washing machine in an embodiment of the present disclosure includes a cabinet 1, a washing drum 2, a water drainage channel 5, an impeller 17, a mounting plate 4, a power device 3 and a damping piece. The impeller 17 can be rotatably arranged in the washing drum 2. The mounting plate 4 is arranged in the cabinet 1 and is arranged below the washing drum 2. The mounting plate 4 is configured to support the washing drum 2, and the support herein can be direct support and can also be indirect support.

In the present embodiment, a power device 3 is installed on a mounting plate 4, for example, installed on a lower surface of a mounting plate 4, and is configured to drive at least one of a washing drum 2 and an impeller 17 to rotate. The power device 3 is provided with a drive shaft assembly which is arranged on the mounting plate 4 in a penetrating manner and which is connected and matched with the mounting plate 4. A water drainage cavity 52 guides liquid thrown away by a washing drum 2 into the mounting plate 4 via a water drainage outlet 21. Wherein a concave cavity structure 16, formed under the match of a water retaining ring 12, on the mounting plate 4 collects water discharged via a water drainage outlet 21, and water is discharged out of a washing machine. A damping piece is installed in a cabinet 1 and is connected with a mounting plate 4.

As shown in FIG. 1 and FIG. 2, the damping piece includes a boom 9 and a boom socket 10, an upper end of the boom 9 is connected with the cabinet 1, and a lower end is connected with a boom socket 10, an edge of the mounting plate 4 is provided with a bayonet which is in match with the boom socket 10, the boom socket 10 is clamped in the bayonet, and is arranged an a lower side of a mounting plate 4, the boom socket 10 is internally installed with a spring, a spring in the boom socket 10 is compressed under an effect of gravity of a mounting plate 4 and a washing drum 2, and the spring plays a role of damping when the washing drum 2 vibrates. The mounting plate 4 is arranged at a lower part of the washing drum 2, such that the boom socket 10 is arranged below the washing drum 2, and does not occupy the space between the washing drum 2 and the cabinet 1, thereby being beneficial for expanding volume of a washing drum 2.

Therefore, through setting a mounting plate 4 and a water retaining ring 12, a concave cavity structure 16 formed under the match of a mounting plate 4 and a water retaining ring 12 not only can accommodate liquid discharged from a water drainage cavity 52, but also can install a power device 3 and a damping piece on a mounting plate 4, thereby realizing effects of bearing a power device 3 and supporting a washing drum 2. A power device is installed at a bottom part of a mounting plate 4, and includes a motor and a decelerating clutch, and a rotating shaft of the motor is directly or indirectly connected with a bottom of a washing drum, so as to drive rotation of a washing drum 2. An output shaft of the power device penetrates through the mounting plate 4 and is connected with the washing drum 2, and at least one motive seal is arranged between the output shaft and a mounting plate 4. Preferably, a bottom part of the mounting plate 4 is provided with multiple reinforcing ribs which protrude downwards.

What is described above is merely the preferred embodiments of the present disclosure, rather than limiting the present disclosure in any form, although the present disclosure has been disclosed above with the preferred embodiments, the preferred embodiments are not used for limiting the present disclosure, those skilled in the art can make some changes or modify into equivalent embodiments with equal changes by utilizing the above suggested technical contents without departing from the scope of the technical solution of the present disclosure, and the contents not departing from the technical solution of the present disclosure, any simple amendments, equivalent changes or modifications made to the above embodiments based on the technical essence of the present disclosure shall all fall within the scope of the solution of the present disclosure.

The invention claimed is:

1. A washing machine, comprising:

a cabinet;

a washing drum, being rotatably arranged in the cabinet and being a water holding drum to accommodate washing water, wherein a lower part of the washing drum is provided with a water drainage outlet;

a water drainage channel, being arranged at an inner side of a peripheral wall of the washing drum and discharging water from top to bottom, wherein an upper end of the water drainage channel is communicated with inside of the washing drum, and a lower end of the water drainage channel is communicated with the water drainage outlet of the washing drum, such that washing water, which rises under an effect of an eccentric force, in the washing drum is guided from top to bottom to the water drainage outlet via the water drainage channel and is discharged;

a water collecting ring arranged on an upper end of the washing drum; and a dehydration outlet which is communicated with the inside of the washing drum is arranged at a side, facing the washing drum, of the water collecting ring, and the upper end of the water drainage channel is communicated with the water collecting ring, to guide and discharge water in the water collecting ring, the water collecting ring is internally provided with a water retaining plate which guides washing water to enter into the water drainage channel after changing direction, and the water retaining plate is arranged directly above the water inlet of the water drainage channel, and is set to be inclined at a certain angle with a horizontal surface at which the water collecting ring is located, and configured so when washing water flows in the water collecting ring in an annular manner, washing water collides onto the water retaining plate, flows downwards along a drum wall and enters into the water drainage pipe.

2. The washing machine according to claim 1, wherein the upper end of the water drainage channel is provided with a water inlet, the water drainage outlet is arranged at a lower part of the peripheral wall of the washing drum or at a bottom of the washing drum, and the water drainage channel defines a water drainage cavity which is communicated with the water inlet and the water drainage outlet.

3. The washing machine according to claim 2, wherein the water drainage cavity is defined jointly through an inner peripheral wall surface of the washing drum covered by the water drainage channel.

4. The washing machine according to claim 1, wherein the water drainage channel comprises a water channel casing and at least part of a washing drum wall, and a side, facing the washing drum wall, of the water channel casing is provided with a cut-through groove, the water channel casing is fastened on the washing drum wall and forms a water flow channel together with the washing drum wall.

5. The washing machine according to claim 4, wherein the water channel casing is detachably installed on the washing drum.

6. The washing machine according to claim 4, wherein projections or veins which are used for being in friction contact with clothes are arranged on a side, facing an axis of the washing drum, of the water channel casing.

7. The washing machine according to claim 6, wherein a lower end of the water drainage channel is connected with the water drainage outlet at the bottom of the washing drum, the water drainage outlet is arranged below an impeller of the washing machine, and the water drainage channel extends to the water drainage outlet.

8. The washing machine according to claim 7, wherein at least one water drainage channel is provided, or at least two water drainage channels are provided and are arranged at intervals along a circumferential direction of the washing drum.

9. The washing machine according to claim 6, wherein the water drainage outlet is arranged at the lower part of the peripheral wall of the washing drum, at least one water drainage outlet is provided, at least one water drainage channel is provided, and each water drainage channel covers at least one corresponding water drainage outlet.

10. The washing machine according to claim 9, wherein at least two water drainage outlets are provided and are arranged at intervals along the circumferential direction of the washing drum, and at least two water drainage channels are provided and are arranged at intervals along the circumferential direction of the washing drum.

11. The washing machine according to claim 1, wherein a top end of the washing drum is provided with a balancing ring, and the water collecting ring is arranged inside the washing drum and at a lower side of the balancing ring.

12. The washing machine according to claim 1, wherein a side, facing an axis of the washing drum, of the water collecting ring is a cambered surface, and the cambered surface is gradually bent from bottom to top towards a center of the washing drum along the axial direction of the washing drum;

the water drainage port of the water collecting ring is arranged at an initial end of a bottom part of the cambered surface.

13. The washing machine according to claim 12, comprising:

a mounting plate installed on a lower part of the washing drum and configured to support the washing drum, wherein the mounting plate is connected with a cabinet via a damping piece.

14. The washing machine according to claim 13, wherein the mounting plate is provided with a water retaining ring, the water retaining ring extends towards the washing drum, to form a concave cavity structure which accommodates washing water, a lower end of the water drainage channel discharges water to the concave cavity structure, and a bottom part of the concave cavity structure is connected with a water drainage pipe which discharges water out of the washing machine;

a height of the water retaining ring is slightly higher than a bottom surface of the washing drum, and a certain gap is reserved between the water retaining ring and an outer peripheral wall of the washing drum.

15. The washing machine according to claim 14, wherein a valve plug configured to open and close the water drainage outlet is installed on the mounting plate, and corresponds to the water drainage outlet at the bottom part of the washing drum, and the valve plug is arranged at a radially inner side of the water retaining ring.

16. The washing machine according to claim 15, wherein the mounting plate is further provided with a locking structure, the locking mechanism is arranged at the bottom part of the washing drum, and is in match with the washing drum, to limit rotation of the washing drum when the water drainage outlet is closed by the valve plug.

17. The washing machine according to claim 16, comprising:

a power device which drives the washing drum to rotate, wherein the power device is installed at a bottom part of the mounting plate, and comprises a motor and a decelerating clutch, and a rotating shaft of the motor is directly or indirectly connected with the bottom of the washing drum, to drive rotation of the washing drum.

18. The washing machine according to claim 13, wherein the damping piece comprises a rod and a rod socket, an edge of the mounting plate is provided to match with the rod socket, and the rod socket is arranged at a lower side of the mounting plate.

* * * * *